United States Patent [19]

Newman

[11] Patent Number: 4,897,059

[45] Date of Patent: Jan. 30, 1990

[54] WATER PUMP FOR MARINE PROPULSION SYSTEM

[75] Inventor: Neil A. Newman, Omro, Wis.

[73] Assignee: Brunswick Corporation, Skokie, Ill.

[21] Appl. No.: 241,614

[22] Filed: Sep. 8, 1988

[51] Int. Cl.[4] ..... B63H 21/10

[52] U.S. Cl. ..... 440/88; 418/154

[58] Field of Search ..... 440/88, 89; 418/154

[56] References Cited

U.S. PATENT DOCUMENTS

| | | | |
|---|---|---|---|
| 2,858,769 | 11/1958 | Doble | 418/154 |
| 3,712,765 | 1/1973 | Smith | 418/154 |
| 4,565,534 | 1/1986 | Bland | 440/88 |

*Primary Examiner*—Sherman D. Basinger
*Assistant Examiner*—Jesus D. Sotelo
*Attorney, Agent, or Firm*—Robert C. Curfiss

[57] ABSTRACT

A corrosion resistant coolant pump for placement in the cooling system of a marine drive includes a corrosion resistant member mounted to and rotatable with a drive shaft interconnected with and rotatable in response to the engine crankshaft. The corrosion resistant member is preferably a cup adapted for receiving and enclosing an end of the drive shaft, with a portion of the cup extending into a cavity formed in the coolant pump housing. The cavity is in communication with marine drive cooling system. An impeller is connected to the cup and housed within the cavity for pumping coolant through the system. The cup is interconnected with the drive shaft so as to be rotatable in response thereto, thereby driving the impeller in response to rotation of the drive shaft. A sealing mechanism is provided about the cup for sealing the cavity and preventing contact of coolant with the drive shaft. With this construction, a carbon steel drive shaft can be utilized in a salt water coolant environment, thereby eliminating the need for constructing the entire drive shaft of a corrosion resistant material.

5 Claims, 1 Drawing Sheet

WATER PUMP FOR MARINE PROPULSION SYSTEM

BACKGROUND AND SUMMARY

This invention relates to a marine propulsion system, an more particularly to an improved coolant pump for circulating coolant through the cooling system of a marine propulsion system.

The invention is directed to a marine propulsion system in which coolant water is taken in through intake ports in the submerged lower unit of the system and thereafter circulated through the engine cooling system. In a typical arrangement for circulating cooling water through the cooling system, a water pump includes an impeller interconnected with a drive shaft which is rotatable in response to rotation of the engine crankshaft. In this manner, the impeller acts to circulate water through the cooling system whenever the engine is running. In such an arrangement, the portion of the drive shaft which is coupled to the pump impeller is exposed to intake cooling water. In fresh water applications, this generally does not present a problem. However, when the intake cooling water is from a salt water body, such exposure of the engine drive shaft to salt water can cause corrosion problems in the drive shaft, which is typically constructed from a carbon steel material. If the portion of the drive shaft to which the pump impeller is connected corrodes excessively, then it may be necessary to replace the entire drive shaft.

One solution to the above-noted problem is to construct the drive shaft of a corrosion resistant material, such as stainless steel. However, corrosion resistant materials such as stainless steels are generally quite expensive, resulting in a high cost solution to a problem which only affects a portion of the drive shaft.

The present invention is designed to allow use of a standard carbon steel drive shaft in a salt water application, while isolating that portion of the carbon steel drive shaft which drives the water pump impeller from the intake cooling water circulating through the engine cooling system. In accordance with the invention, a corrosion resistant coolant pump for placement in the cooling system of a marine drive includes a housing having a cavity in communication with the marine drive cooling system. A corrosion resistant member is mounted to and rotatable with a drive shaft, which is interconnected with the engine crankshaft so as to be rotatable in response to rotation thereof. An impeller disposed within the housing cavity and is connected to the corrosion resistant member. The impeller is rotatable in response to rotation of the corrosion resistant member caused by rotation of the drive shaft, for pumping coolant through the cooling system. Seal means is provided about the corrosion resistant member for sealing the housing cavity and preventing contact of coolant with the rotatable shaft. In one embodiment, the corrosion resistant member comprises a cup formed from a corrosion resistant material, such as stainless steel. The cup includes an inner passage adapted to receive and enclose an end of the rotatable drive shaft. The cup is interconnected with the engine drive shaft so as to be rotatable therewith, such as by a key and groove connection or the like. The cup preferably includes a portion extending into the housing cavity, and the impeller is preferably connected to the portion of the cup extending into the housing cavity. The seals means preferably comprises a pair of seals for isolating the carbon steel drive shaft from the coolant circulating within the housing cavity. In one embodiment, a first seal is provided adjacent the housing cavity, and a second seal is spaced from the first seal so as to form a gap there-between. A drain means is in communication with the gap formed between the first and second seals for draining any coolant which may leak past the first seal prior to its contacting the drive shaft by leaking through the second seal.

The invention thus provides a relatively inexpensive solution to the problem of drive shaft corrosion when operating the marine drive in a salt water environment. A standard carbon steel drive shaft is employed and only a relatively small part, namely the cup mounted to the end of the drive shaft, is constructed of the expensive stainless steel material.

BRIEF DESCRIPTION OF THE DRAWING

The drawings illustrate the best mode presently contemplated of carrying out the invention.

In the drawings.

DETAILED DESCRIPTION OF THE PREFERRED EMBODIMENT

Figure 1:
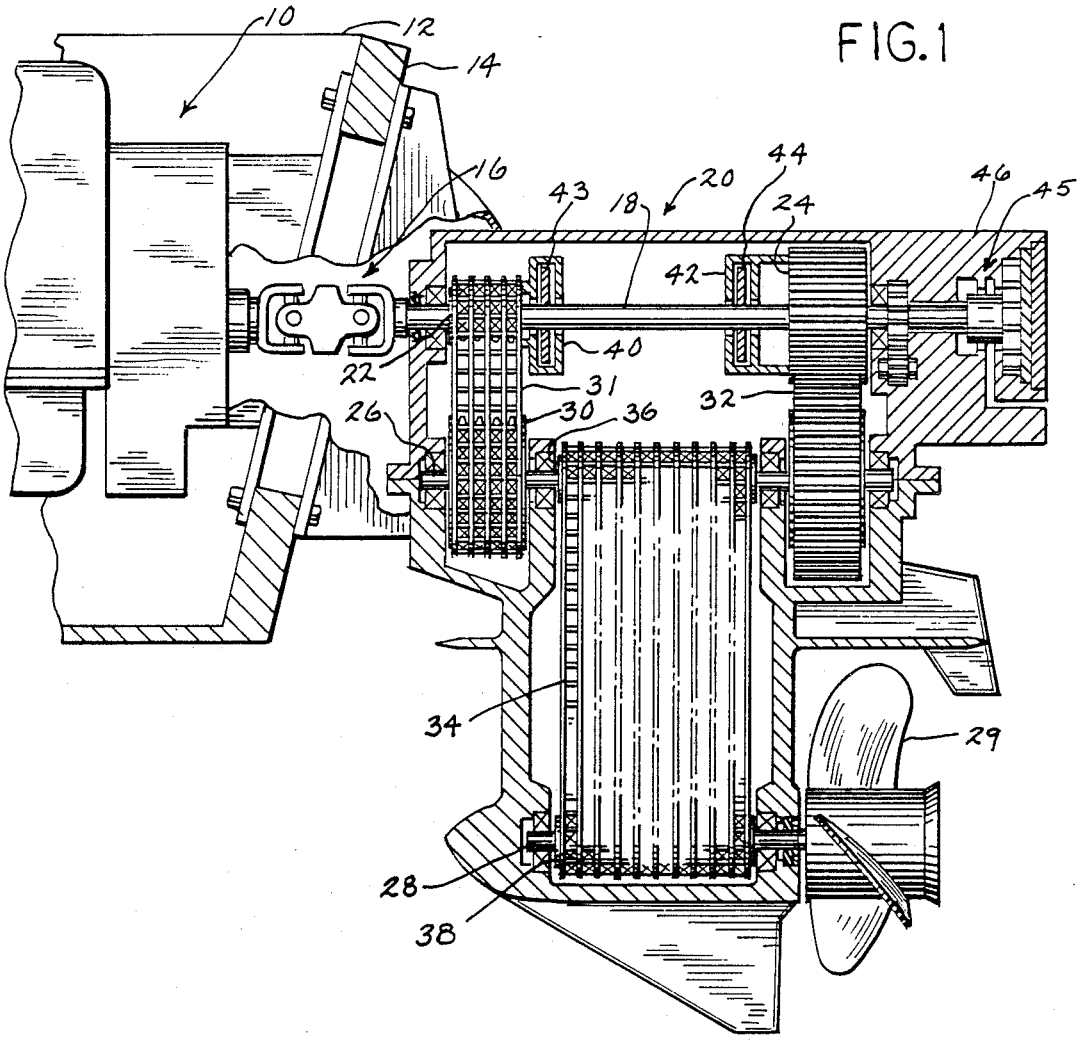
FIG. 1 is a partial elevation view, partially in section, showing an inboard/outboard stern drive marine propulsion system incorporating the improved water pump of the invention.

With references to FIG. 1, an inboard/outboard stern drive marine propulsion system generally includes an engine 10 mounted in the interior of a boat 12 adjacent its transom 14. Engine 10 includes a crankshaft (not shown) interconnected with a universal joint 16, to which a drive shaft 18 is connected at its leftward end. Drive shaft 18 is housed in the upper portion of a drive unit housing, shown generally 20, mounted to the exterior of transom 14. As is known, drive unit housing 20 is mounted to transom 14 so as to be pivotable about a substantially horizontal tilt axis and a substantially vertical steering axis, such movement being accommodated by provision of universal joint 16.

The drive system contained within the interior of drive unit housing 20 is generally similar to that described in copending application Ser. No. 244,994 filed Sept. 15, 1988 and entitled "Stern Drive Marine Propulsion System Including A Chain Drive Mechanism". The marine drive system housed within drive unit housing 20 generally includes an upper sprocket 22 mounted adjacent the forward end of 15 drive shaft 18 and an upper gear 24 mounted to drive shaft 18 and spaced from sprocket 22. An intermediate shaft 26 is mounted in drive unit housing 20 below drive shaft 18. Intermediate shaft 26 is disposed above a propeller shaft 28 rotatably mounted in the lower portion of drive unit housing 20, to which a propeller 29 is mounted. A front sprocket 30 is mounted to intermediate shaft 26 and aligned with front sprocket 22 on drive shaft 18, and a chain 31 drivingly engages sprockets 22 and 30. A gear 32 is mounted to intermediate shaft 26 and is engageable with gear 24 mounted to drive shaft 18. A drive chain 34 extends between a sprocket 36 mounted to intermediate shaft 26 and a sprocket 38 mounted to propeller shaft 28.

A sprocket clutch 40 is interconnected with front sprocket 22 on drive shaft 18, and a gear clutch 42 is interconnected with gear 24 on drive shaft 18. Clutches 40, 42 are selectively actuable for selectively coupling either sprocket 22 or gear 24 to drive shaft 18 via a pair of disks 43, 44 mounted to drive shaft 18, so as to selectively impart rotation in either a first or second rotational direction to intermediate shaft 26. Such rotation of intermediate shaft 26 is transferred through intermediate shaft sprocket 36 and chain 34 to propeller shaft sprocket 38 and through propeller shaft 28 to propeller 29. Further reference should be made to the above-noted copending application for further details of tho described marine drive mechanism.

Figure 2:
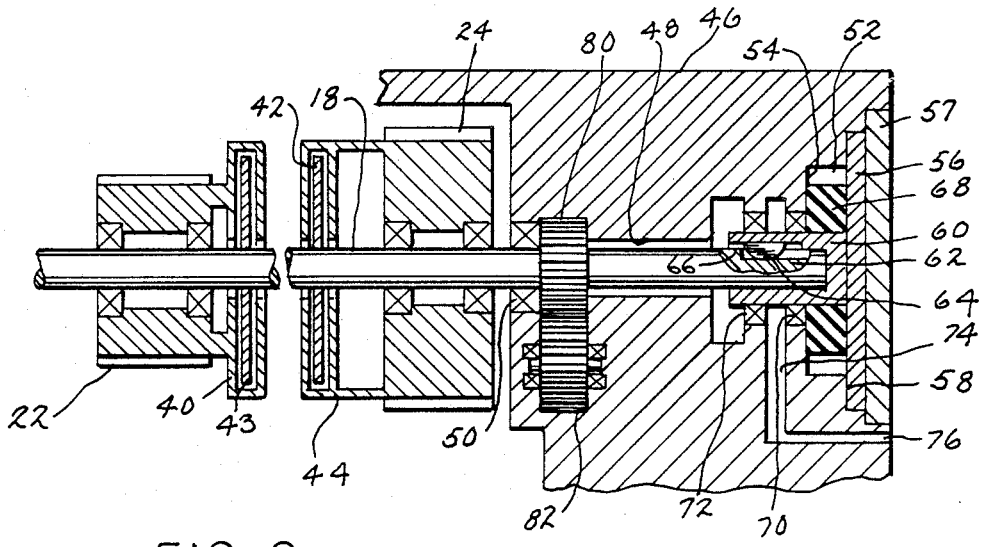
FIG. 2 is a detailed partial sectional view showing the components of the improved water pump construction according to the invention.

An improved water pump assembly, shown generally at 45, is provided at the upper rear portion of drive unit housing 20. Water pump assembly 45 includes a housing 46 cast integrally with drive unit housing 20. Water pump housing 46 includes a passage 48 (FIG. 2) adapted to accommodate the rightward end of drive shaft 18. A bearing 50 is mounted at the leftward end of passage 48 for supporting drive shaft 18 at its point of entry into housing 46.

Water pump housing 46 provides a impeller cavity 52 at its rightward end. Cavity 52 is formed by a recess 54 formed in the rightward end of water pump housing 46, with recess 54 being sealed by means of a sealing plate 56 mounted to a shoulder 58 formed in water pump housing 46. Cavity 52 is in fluid communication with the engine cooling system. A removable cover plate 57 is mounted to housing 46 over sealing plate 56.

A stainless steel cup 60 includes an inner passage 62 adapted to receive and enclose the rightward end of drive shaft 18. Cup 60 is interconnected with the rightward end of drive shaft 18 by means of a key 64 engaged within a slot 66 formed in drive shaft 18. In this manner, cup 60 is engaged to a rotatable with drive shaft 18.

Cup 60 includes a portion which projects into cavity 52, and an impeller 68 is fixed to and rotatable with the portion of cup 60 extending into cavity 52. With this construction, rotation of drive shaft 18 is transferred through cup 60 to impeller 68, so that impeller is driven whenever drive shaft 18 is driven by engine 10 so as to circulate coolant through the engine cooling system.

A pair of seals 70, 72 are provided about the exterior surface of cup 60 for sealing cavity 52, while accommodating rotation of cup 60 during operation. With the provision of seals 70, 72, coolant present within cavity 52 is isolated from drive shaft 18. That is, during operation coolant within cavity 52 only contacts the portion of cup 60 which extends into cavity 52, and seals 70, 72 act to prevent contact of coolant with any portion of drive shaft 18. In this manner, corrosion of drive shaft 18 caused by contact of coolant therewith is prevented.

First seal 70 is mounted within an internal opening formed in water pump housing 46 adjacent cavity 52 so as to fully seal cavity 52. Second seal 72 is likewise mounted within an opening internal formed in housing 46, and is spaced from first seal 70. In this manner, a gap is formed between first and second seals 70, 72.

A downwardly extending substantially vertical passage 74 is in fluid communication with the gap provided between seals 70, 72 for draining coolant thereform which may leak past first seal 70 during operation. Downwardly extending passage 74 includes a discharge outlet 76 open to ambient pressure, for draining any coolant contained within the gap between seals 70, 72. With this construction, any possible leakage of coolant through second seal 72 and into contact with drive shaft 18 is prevented.

With the above-described construction, it is possible to utilize a conventional carbon steel drive shaft in a marine propulsion cooling system in a salt water environment. The drive shaft is isolated by means of stainless steel cup 60, which is corrosion resistant and capable of withstanding the possible corrosive effect of the coolant pumped by impeller 68. In the event cup 60 or impeller 68 need replacement or repair, it is necessary only to remove end plate 56 so as to gain access to cavity 52 and the components therein which require attention.

An oil pump assembly, including a driving gear 80 and a driven gear 82, is mounted within the leftward end of housing 46 for circulating oil to gears 24, 32.

While the invention has been described with reference to a stern drive system, it is to appreciated that the invention is equally suitable for use in an outboard system in which the drive shaft is oriented substantially vertically. It is also to be understood that the water pump assembly of the invention may be located anywhere along the length cf the rotatable drive shaft, and is not necessarily limited to a location at an end of the drive shaft as described.

Various alternatives and modifications are contemplated as being within the scope of the following claims particularly pointing out and distinctly claiming the invention.

I claim:

1. A corrosion resistant coolant pump for placement in the cooling system of a marine drive, said marine drive including an engine and a rotatable shaft rotating when said engine is running, comprising:

a housing including a cavity in communication with said marine drive cooling system;

a corrosion resistant member mounted to and rotatable with said rotatable shaft mounted within said housing;

impeller means connected to said corrosion resistant member so as to be rotatable in response to rotation thereof for pumping coolant in said cooling system, said impeller means being disposed within said housing cavity;

seal means provided about said corrosion resistant member for sealing said housing cavity and preventing contact of coolant with said rotatable shaft, wherein said seal means comprises a pair of seals provided about said corrosion resistant member between a side of said housing cavity and said rotatable shaft, and including a first seal adjacent said housing cavity and a second seal spaced from said first seal so that a gap is formed between said first and second seals; and drain means in communication with said gap formed between said first and second seals for draining coolant which leaks from said housing cavity through said first seal before said coolant reaches said second seal.

2. The corrosion resistant coolant pump of claim 1, wherein said corrosion resistant member comprises cup means formed of a corrosion resistant material and including an inner passage for receiving and enclosing an end of said rotatable shaft.

3. The corrosion resistant coolant pump of claim 1, wherein said drain means comprises a passage formed in said housing and in communication with said gap formed between said first and second seals, said passage having an outlet port for discharging coolant from said housing.

4. The corrosion resistant coolant pump of claim 1, wherein said housing cavity is formed adjacent an outer surface of said housing by a recess formed in said outer housing surface, with said impeller means disposed within said recess, and wherein said housing cavity is sealed by means of a sealing plate mounted to said outer housing surface for sealing said housing cavity and maintaining said impeller means therein.

5. A corrosion resistant coolant pump assembly for placement in the cooling system of marine drive, said marine drive including an engine, comprising:

a housing including a cavity in communication with said marine drive cooling system;

a rotatable shaft interconnected with the engine of said marine drive so as to rotate when the engine is running, with an end of said rotatable shaft being located adjacent said housing cavity;

a corrosion resistant cup having an inner passage for receiving and enclosing the end of said rotatable shaft adjacent said housing cavity;

a pump impeller disposed within said housing cavity and interconnected with said corrosion resistant cup so as to be rotatable in response to rotation of said rotatable shaft;

a pair of seals provided about said corrosion resistant cup for sealing said housing cavity and preventing contact of coolant with said rotatable shaft, with a first seal being disposed adjacent said housing cavity and a second seal spaced from said first seal to form a gap therebetween; and drain means in communication with the gap formed between said first and second seals for draining coolant therefrom and preventing coolant from leaking through said second seal and into contact with said rotatable shaft.

* * * * *